US008430151B2

(12) United States Patent
Kim

(10) Patent No.: US 8,430,151 B2
(45) Date of Patent: Apr. 30, 2013

(54) INTEGRATED HYBRID HEAT EXCHANGER USING WATER HEAD DIFFERENCE

(75) Inventor: Jae Yeon Kim, Gyunggi-Do (KR)

(73) Assignee: Hyundai Motor Company, Seoul (KR)

( * ) Notice: Subject to any disclaimer, the term of this patent is extended or adjusted under 35 U.S.C. 154(b) by 985 days.

(21) Appl. No.: 12/488,185

(22) Filed: Jun. 19, 2009

(65) Prior Publication Data

US 2010/0116458 A1 May 13, 2010

(30) Foreign Application Priority Data

Nov. 10, 2008 (KR) ..... 10-2008-0111177

(51) Int. Cl.
*B60H 1/00* (2006.01)

(52) U.S. Cl.
USPC ..... 165/41; 165/174

(58) Field of Classification Search ..... 165/101, 165/153, 41, 174, 104.32, 139, 140, 917
See application file for complete search history.

(56) References Cited

U.S. PATENT DOCUMENTS

| | | | | |
|---|---|---|---|---|
| 5,526,873 | A * | 6/1996 | Marsais et al. | 165/51 |
| 5,575,329 | A * | 11/1996 | So et al. | 165/167 |
| 6,789,613 | B1 * | 9/2004 | Ozaki et al. | 165/140 |
| 6,942,023 | B2 * | 9/2005 | Fang et al. | 165/140 |
| 6,997,143 | B2 * | 2/2006 | Piccirilli et al. | 123/41.1 |
| 7,059,393 | B2 * | 6/2006 | Fang et al. | 165/140 |
| 7,096,930 | B2 * | 8/2006 | Nobuta et al. | 165/132 |
| 7,096,932 | B2 * | 8/2006 | Scoville et al. | 165/140 |
| 7,306,030 | B2 * | 12/2007 | Luvisotto et al. | 165/284 |
| 7,322,399 | B2 * | 1/2008 | Guerrero et al. | 165/101 |
| 7,506,683 | B2 * | 3/2009 | Hu | 165/140 |
| 7,669,558 | B2 * | 3/2010 | Claypole et al. | 123/41.51 |
| 7,699,028 | B2 * | 4/2010 | Guerrero et al. | 123/41.29 |
| 7,779,893 | B2 * | 8/2010 | Leitch et al. | 165/70 |
| 2005/0269062 | A1 * | 12/2005 | Guerrero et al. | 165/101 |
| 2006/0207755 | A1 * | 9/2006 | Kalbacher | 165/140 |
| 2008/0034767 | A1 * | 2/2008 | Ziehr et al. | 62/180 |

FOREIGN PATENT DOCUMENTS

| | | | |
|---|---|---|---|
| JP | 06-081648 | A | 3/1994 |
| JP | 10-259721 | A | 9/1998 |
| JP | 10-266855 | A | 10/1998 |
| JP | 2006-021749 | A | 1/2006 |

* cited by examiner

*Primary Examiner* — Marc Norman
*Assistant Examiner* — Devon Russell
(74) *Attorney, Agent, or Firm* — Morgan, Lewis & Bockius LLP

(57) ABSTRACT

An integrated hybrid heat exchanger may include a first radiator and a second radiator disposed up and down in parallel, a first radiator tank connected to both first end portions of the first and second radiators in common, a first baffle installed in the first radiator tank and separating an inner space of the first radiator tank into an upper space and a lower space, wherein the upper and lower spaces of the first radiator tank include a coolant inlet respectively and a first air bypass member having a passage therein, the first air bypass member installed on the first baffle and extending upwards with a predetermined length and configured to remove bubbles collected in the lower space of the first radiator tank through the passage of the first air bypass member by pressure difference between the upper and lower spaces of the first radiator tank.

17 Claims, 3 Drawing Sheets

INTEGRATED HYBRID HEAT EXCHANGER USING WATER HEAD DIFFERENCE

CROSS-REFERENCE TO RELATED APPLICATION

The present application claims priority to Korean Patent Application No. 10-2008-0111177 filed Nov. 10, 2008, the entire contents of which application is incorporated herein for all purposes by this reference.

BACKGROUND OF THE INVENTION

1. Field of the Invention

The present disclosure relates to an integrated hybrid heat exchanger for a hybrid vehicle. More particularly, it relates to an integrated hybrid heat exchanger using a water head difference, in which an electrical component cooling system and an internal combustion engine cooling system are integrated into a single cooling system such that bubbles generated in the cooling system during operation can be easily removed, thereby improving cooling efficiency.

2. Description of Related Art

In general, a hybrid vehicle is a vehicle that is equipped with an internal combustion engine and a motor such that the vehicle is driven by one or both of the engine and the motor.

The hybrid vehicle is driven by the motor during initial driving or during cruise driving and is driven by the internal combustion engine during uphill driving or during battery discharge, thus improving fuel efficiency.

Here, since electrical components including the motor generate heat during operation, it is necessary to provide a cooling system that prevents an increase in the temperature of the components in order to maintain the input and output characteristics of the components at an optimum state.

Especially, in the case of a battery, it is necessary to maintain an optimum temperature in order to maintain the overall charge-discharge efficiency at its best.

Accordingly, the heat generated during the charge and discharge of the battery is cooled to the optimum temperature using the cooling system.

For example, when the hybrid vehicle is driven by the motor, heat is generated by a phase shift of current (AC to DC) in an inverter, and heat is also generated during operation of the motor and an electric generator. In order to cool these electrical components, the hybrid vehicle includes an electrical component cooling system in which cooling water is circulated through an electric pump→the inverter→an inverter reservoir tank→a radiator during operation of the motor.

Accordingly, a hybrid cooling system is operated by two cooling systems including the electrical component cooling system and an internal combustion engine cooling system.

In this hybrid cooling system, the internal pressures of an integrated radiator, in which individual radiators are hydraulically isolated from fluid communication with each other, may be different from each other according to the operation of the internal combustion engine and the electric motor, the flow rate of a water pump, and the temperature of coolant. In this case, the dynamic pressures may be different from each other even if the total pressures are the same.

Recently, an integrated cooling system, in which the electrical component cooling system and the internal combustion engine cooling system are integrated into a single cooling system so as to provide an improvement in cooling efficiency, an advantage of layout design, a reduction in the number of components, and a reduction in manufacturing cost, is proposed.

For example, Japanese Patent Publication No. 1998-259721 and U.S. Pat. No. 6,124,644 disclose cooling systems, in which an existing internal combustion engine radiator is divided into a radiator for an internal combustion engine and a radiator for electrical components.

However, in the case of the cooling system disclosed in Japanese Patent Publication No. 1998-259721, bubbles formed in the radiator for the electrical components are collected at the top of a tank; however, since an outlet for discharging the collected bubbles is situated at the bottom, it is difficult to remove the collected bubbles from the tank, thus deteriorating the cooling efficiency.

Moreover, the temperature and pressure of the radiator for the internal combustion engine and the radiator for the electrical components are set to be different from each other in the above cooling system and, therefore, if an excess pressure is generated in one of the radiator for the internal combustion engine and the radiator for the electrical components, the pressure difference between the two radiators causes core deformation and fatigue failure, thus reducing the durability.

In the case of the cooling system disclosed in U.S. Pat. No. 6,124,644, in which bubbles collected at an upper tank of the radiator are removed only when the radiator cap is opened, since the tank of the radiator for the electrical components has a size smaller than the radiator for the internal combustion engine, the space for collecting bubbles is insufficient, which restricts the coolant flow, thus deteriorating the cooling efficiency.

Moreover, the temperature and pressure of the radiator for the internal combustion engine and the radiator for the electrical components are also set to be different from each other in this cooling system and, therefore, if an excess pressure is generated in one of the radiator for the internal combustion engine and the radiator for the electrical components, the pressure difference between the two radiators causes core deformation and fatigue failure, thus reducing the durability.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE DISCLOSURE

Various aspects of the present invention are directed to provide an integrated hybrid heat exchanger using a water head difference, in which a radiator for electrical components and a radiator for an internal combustion engine are integrated into a single structure, in which each of the two radiators has an independent coolant flow structure in which the flow of liquid fluid is reduced by a pressure difference between the two radiators such that coolant in the radiator for the internal combustion engine and coolant in the radiator for the electrical components are not mixed with each other, and a tube is provided to connect the insides of the radiators such that bubbles generated in radiator tanks during operation of the radiators can be effectively discharged, thus improving cooling efficiency.

In one aspect, the present invention provides an integrated hybrid heat exchanger, that may have a first radiator and a second radiator disposed up and down in parallel, a first radiator tank connected to both first end portions of the first and second radiators in common, a first baffle installed in the first radiator tank and separating an inner space of the first radiator tank into an upper space and a lower space, wherein the upper and lower spaces of the first radiator tank include a coolant inlet respectively so as to fluidly-connect the upper space of the first radiator tank to the first radiator and the coolant inlet installed at the upper space of the first radiator tank and to fluidly-connect the lower space of the first radiator tank to the second radiator and the coolant inlet installed at the lower space of the first radiator tank, and a first air bypass member having a passage therein, the first air bypass member installed on the first baffle and extending upwards with a predetermined length and configured to remove bubbles collected in the lower space of the first radiator tank through the passage of the first air bypass member by pressure difference between the upper and lower spaces of the first radiator tank.

The first air bypass member may be configured to minimize a flow of fluid therethrough while discharging the bubbles when an excess pressure is generated in one of the first and second radiators.

The first air bypass member may be formed integrally with the first baffle or assembled on the first baffle in an insertion manner.

The first baffle may be disposed at the same level as a bottom portion of the first radiator and the predetermined length of the first air bypass member is shorter than the height of the first radiator from the bottom portion thereof.

The upper space of the first radiator tank may fluidly-connected to a reservoir tank.

In another aspect of the present invention, the integrated hybrid heat exchanger may include a second radiator tank connected to both second end portions of the first and second radiators in common, a second baffle installed in the second radiator tank and separating an inner space of the second radiator tank into an upper space and a lower space, wherein the upper and lower spaces of the second radiator tank include a coolant outlet respectively so as to fluidly-connect the upper space of the second radiator tank to the first radiator and the coolant outlet installed at the upper space of the second radiator tank and to fluidly-connect the lower space of the second radiator tank to the second radiator and the coolant outlet installed at the lower space of the second radiator tank, and a second air bypass member having a passage therein, the second air bypass member installed on the second baffle and extending upwards with a predetermined length and configured to remove bubbles collected in the lower space of the second radiator tank through the passage of the second air bypass member by pressure difference between the upper and lower spaces of the second radiator tank.

The second air bypass member may be configured to minimize a flow of fluid therethrough while discharging the bubbles when an excess pressure is generated in one of the first and second radiators.

The second air bypass member may be formed integrally with the second baffle.

The second air bypass member may be assembled on the second baffle in an insertion manner.

The second baffle may be disposed at the same level as a bottom portion of the second radiator and the predetermined length of the second air bypass member is shorter than the height of the second radiator from the bottom portion thereof.

The upper space of the second radiator tank may fluidly-connected to a reservoir tank and the upper space of the first radiator tank may fluidly-connected to the reservoir tank.

The coolant outlet of the first radiator may be disposed lower than the coolant inlet thereof.

The coolant outlet of the second radiator may be disposed lower than the coolant inlet thereof.

The first radiator may be configured to cool an internal combustion engine and the second radiator is configured to cool electrical components.

The thicknesses of cores of the first and second radiators may be different from each other.

In further another aspect of the present invention, longitudinal axes of the first and second radiators are slanted with a predetermined angle to align the second radiator tank to be higher than the first radiator tank so as to control a flow rate of the bubbles between the first radiator tank and the second radiator tank.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
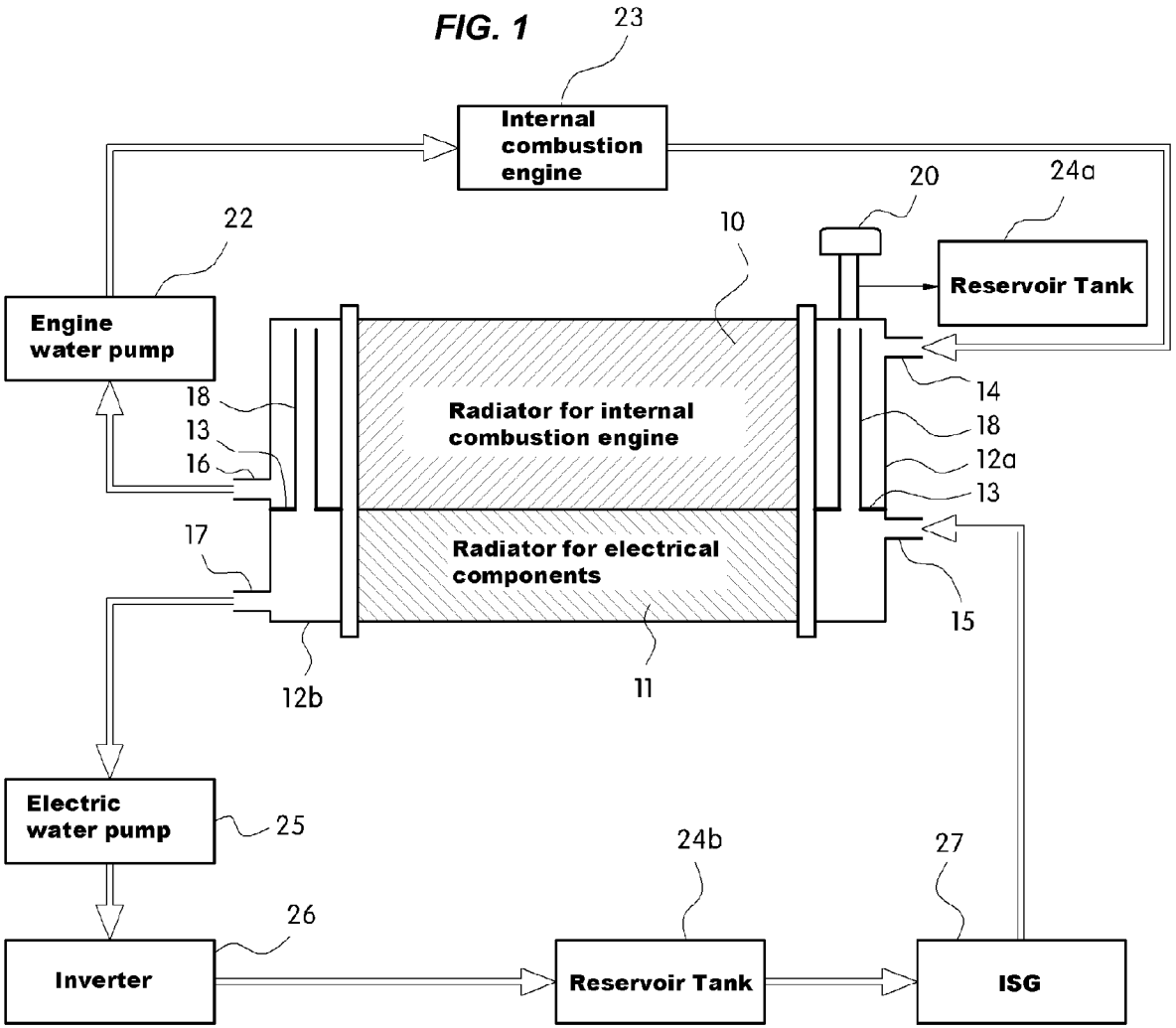
FIG. 1 is a schematic diagram showing an integrated hybrid heat exchanger using a water head difference in accordance with an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

FIG. 1 is a schematic diagram showing an integrated hybrid heat exchanger using a water head difference in accordance with various embodiments of the present invention.

As shown in FIG. 1, in a hybrid cooling system including two cooling systems such as an electrical component cooling system and an internal combustion engine cooling system, the integrated hybrid heat exchanger is constructed by combining a radiator 11 for electrical components and a radiator 10 for an internal combustion engine, each having an independent coolant flow structure, into a single structure and by including a connection structure between the two radiators. Therefore, the integrated hybrid heat exchanger of the present invention facilitates the removal of bubbles generated during operation of the cooling system, minimizes the flow of liquid fluid while discharging the bubbles, and, if an excess pressure is generated in one of the two radiators, relieves the excess pressure to balance the pressures of both radiators, thus improving cooling efficiency and preventing cores from being deformed or damaged.

For this purpose, the radiator 10 for the internal combustion engine and the radiator 11 for the electrical components are arranged up and down in parallel and combined into a single structure, each of the two radiators having an independent coolant flow passage. Radiator tanks 12*a* are connected to one sides of the radiator 10 for the internal combustion engine and the radiator 11 for the electrical components in common. Radiator tanks 12*b* are connected to the other sides of the radiator 10 for the internal combustion engine and the radiator 11 for the electrical components, in common. A baffle 13 is installed in each of the two radiator tanks 12*a* and 12*b* such that the inner space of each radiator tank is divided into upper and lower spaces.

As a result, the upper space in each of the radiator tanks 12*a* and 12*b* is connected to the radiator 10 for the internal combustion engine, and the lower space is connected to the radiator 11 for the electrical components.

A coolant inlet 14 for an internal combustion engine and a coolant outlet 16 for an internal combustion engine are installed in the upper space of each of the radiator tanks 12*a* and 12*b* to supply and discharge coolant therethrough, and a coolant inlet 15 for electrical components and a coolant outlet 17 for electrical components are installed in the lower space of each of the radiator tanks 12*a* and 12*b*.

Here, it is preferable that the coolant inlets 14 and 15 be positioned at a height greater than that of the coolant outlets 16 and 17 respectively.

With the use of the coolant inlets 14 and 15 and the coolant outlets 16 and 17, it is possible to construct two kinds of cooling circuits for the internal combustion engine and for the electrical components.

For example, the cooling circuit for the internal combustion engine may includes: the coolant outlet 16 for the internal combustion engine→an engine water pump 22→an internal combustion engine 23→the coolant inlet 14 for the internal combustion engine. The cooling circuit for the electrical components may include: the coolant outlet 17 for the electrical components→an electric water pump 25→an inverter 26→a reservoir tank 24*b*→an ISG 27→the coolant inlet 15 for the electrical components.

A line extending from one side of a cap 20 mounted at the top of the radiator tank 12*a* is connected to a reservoir tank 24*a*.

Moreover, the thicknesses of cores used in the radiator 10 for the internal combustion engine and the radiator 11 for the electrical components may be different from each other in accordance with required heat capacities.

For example, in the case where the electrical components have a high capacity, the thicknesses of the cores used in the radiator 11 for the electrical components may be set to a thickness suitable for high capacity heat exchange.

Particularly, the present invention provides a structure in which the upper and lower spaces of the radiator tanks 12*a* and 12*b* divided by the baffle 13 are connected to each other.

For this purpose, at least one tube 18 extending to the top is installed on the baffle 13 and, thereby, the upper and lower spaces of the radiator tanks 12*a* and 12*b* are fluidly connected to each other such that bubbles collected in the lower space can be moved to the upper space.

Here, the height of the tube 18 may be determined appropriately in consideration of the pressure and flow rate applied to the radiators.

In this case, the tube 18 may be integrally formed with the baffle 13 during the formation of the baffle 13 or separately formed and attached to the baffle 13 in an insertion manner such that the tube 18 may be inserted into and coupled to an engagement protrusion formed on the baffle 13.

The tube 18 may perform the function of controlling the pressure difference between the two radiators in addition to the function of discharging bubbles.

For example, when the pressure of any of the radiators rises excessively, the tube 18 serves as a bypass passage connecting the two radiators, minimizes the flow of liquid fluid while discharging the bubbles, and serves as a pressure control means. As a result, the tube 18 can balance the pressures of both radiators and accommodate the load due to the pressure, thus improving the durability.

That is, when an excess pressure is generated in one of the radiators, which are hydraulically isolated from fluid communication with each other, the pressure difference between the two radiators may cause core deformation and fatigue failure. However, the bypass passage of the tube 18 allows the pressures of both radiators to be balanced since a small amount of coolant temporarily flows and the bubbles are also moved by the pressure difference between the two radiators, thus ensuring the durability.

Meanwhile, in the integrated hybrid heat exchanger provided by the present invention, pressure caps of the internal combustion engine cooling system and the electrical component cooling system may be set to be different from each other.

For example, the pressure cap of the internal combustion engine cooling system may be set to 1.1 bar and the pressure cap of the electrical component cooling system may be set to 0.4 bar.

In the case where the tube 18 is applied to the heat exchanger under the above conditions, if the pressure of the internal combustion engine cooling system is greater than that of the electrical component cooling system, bubbles collected at the upper space of the radiator tank 12*a* for the internal combustion engine may be temporarily moved to the lower space of the radiator tank 12*a* for the electrical components through the tube 18 connected to the top of the radiator tank 12*a* by the pressure difference between the two radiators.

However, the bubbles are moved again to the radiator 10 for the internal combustion engine faster than the liquid coolant by the buoyancy of bubbles, thus minimizing the flow of the liquid coolant into the radiator 11.

Contrarily, if the pressure of the electrical component cooling system is greater than that of the internal combustion engine cooling system, the coolant may temporarily flow to the radiator 10 for the internal combustion engine only if the pressure difference between the upper and lower portions is greater than the potential energy difference (specific weight× height difference) of the upper portion of the tube 18.

However, since the electric water pump 25 is smaller than the engine water pump 22 and the pressure difference between the internal combustion engine cooling system and the electrical component cooling system, i.e., between the two radiators, is smaller than the water head difference, the coolant flow is temporarily caused even in the case where the pressures of both radiators are set to be different from each other. As a result, the coolant flow is restricted, and thus the problem related to the coolant flow is not considered serious.

That is, even in the case where the tube 18 is used to connect the radiator tanks 12*a* and 12*b* having different pressures, the bubbles can be easily removed and, since the coolant flow between upper and lower spaces of the radiators 12*a* and 12*b* due to the pressure occurs restrictively and temporarily, the problem related to the coolant flow may be completely eliminated.

For example, if $(P2/\gamma - P1/\gamma) < h/\gamma$, the coolant flow does not occur.

In the opposite case, the length of the tube 18 is extremely short; however, in most cases, the radiator 10 for the internal combustion engine is two times greater than the radiator 11 of the electrical components.

Moreover, if $(P1/\gamma - P2/\gamma)$<the buoyancy of bubbles, the coolant flow also does not occur.

In the opposite case, the coolant flows at the bottom and then flows to the top, or a portion of coolant positioned at the top with respect to the end of the tube is moved.

Here, P1 represents the pressure of the radiator 10 for the internal combustion engine, P2 represents the pressure of the radiator 11 for the electrical components, h represents the potential energy (the length of the tube), and $\gamma$ represents the specific weight of coolant.

The coolant flow according to operation conditions in the integrated hybrid heat exchanger using a water head difference will be described below.

Figure 2:
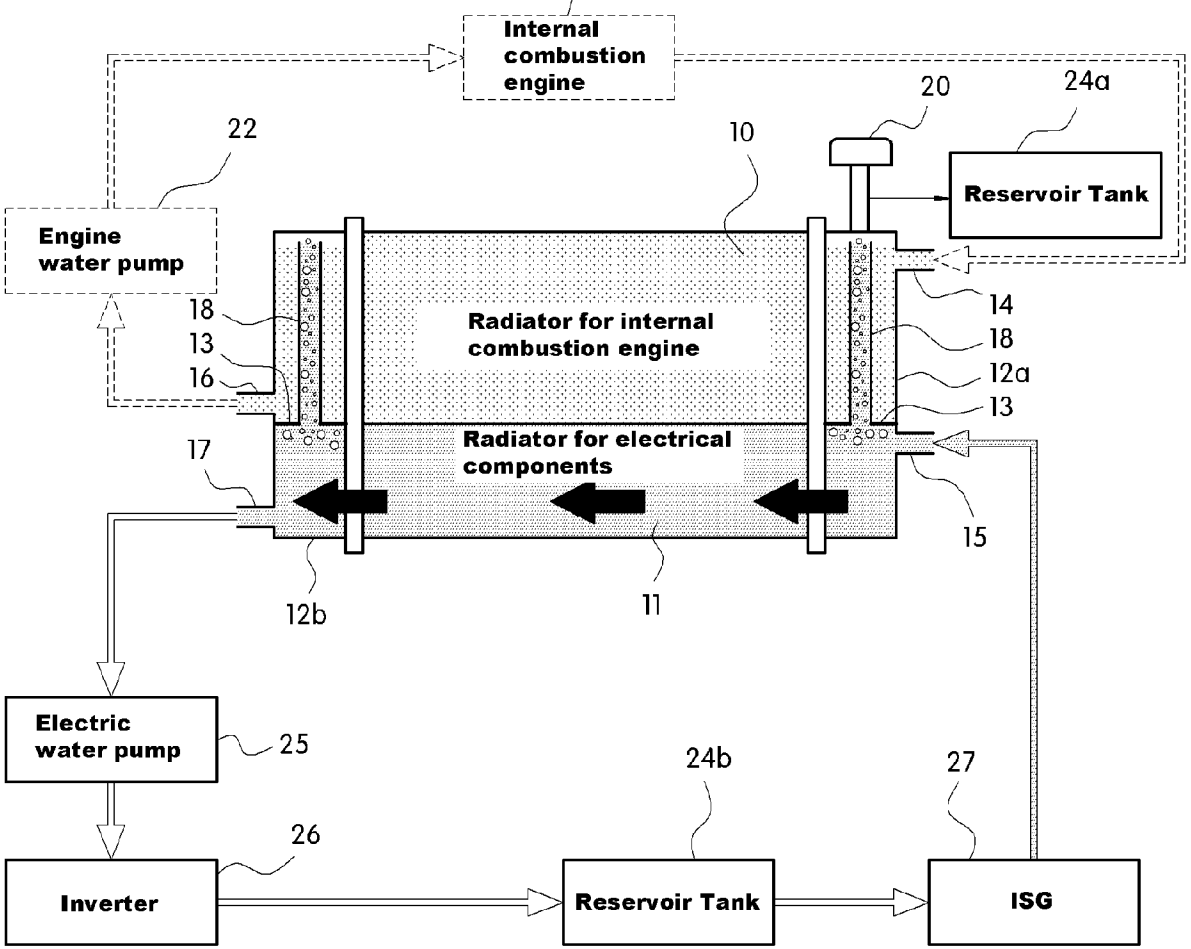
FIG. 2 is a schematic diagram showing coolant flow during operation of electrical components in the integrated hybrid heat exchanger using a water head difference in accordance with the exemplary embodiment of the present invention.

FIG. 2 is a schematic diagram showing the coolant flow during operation of the electrical components in the integrated hybrid heat exchanger using a water head difference in accordance with various embodiments of the present invention.

In FIG. 2, the coolant flow during operation of the electrical components in a condition where the vehicle speed is less than 40 KPH is shown.

At this time, since the engine water pump 22 is not driven, the coolant does not flow in the internal combustion engine cooling system.

The coolant at a relatively high temperature received from the electric water pump 25 is fed into the lower space of the radiator tank 12*a* through the coolant inlet 15 for the electrical components. Then, the coolant is cooled by passing through the radiator 11 for the electrical components, and the cooled coolant is supplied to the electrical components through the outlet 17 for the electrical components in the radiator tank 12*b*.

At this time, the bubbles collected in the lower spaces of the radiator tanks 12*a* and 12*b*, i.e., at the bottom of the baffle 13, can be moved to the top through the tube 18, and then removed through the reservoir tank 24*a*.

Of course, a portion of bubbles may be removed through the reservoir tank 24*b*.

Figure 3:
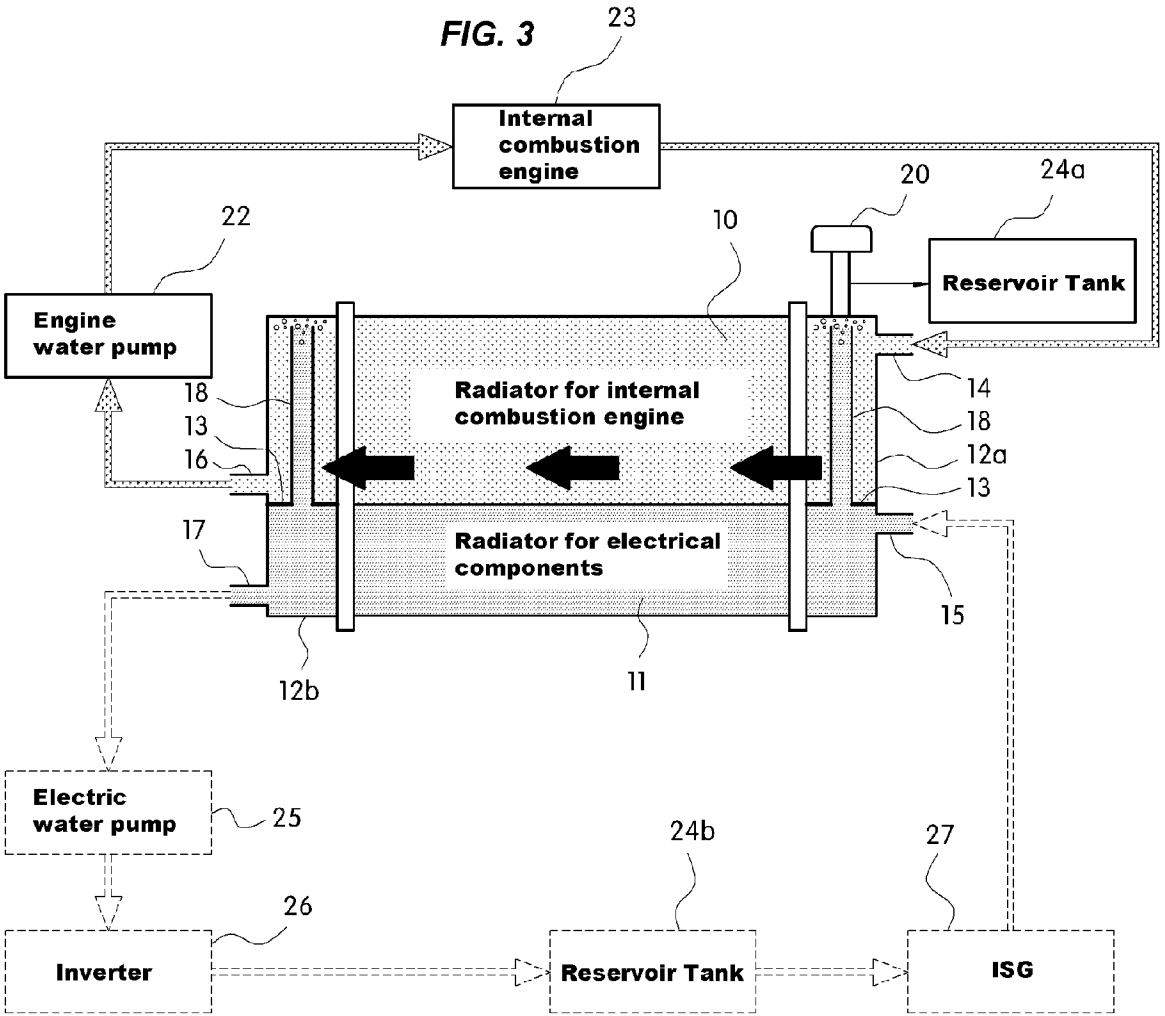
FIG. 3 is a schematic diagram showing coolant flow during operation of an internal combustion engine in the integrated hybrid heat exchanger using a water head difference in accordance with the exemplary embodiment of the present invention.

FIG. 3 is a schematic diagram showing the coolant flow during operation of the internal combustion engine in the integrated hybrid heat exchanger using a water head difference in accordance with various embodiments of the present invention.

As shown in FIG. 3, since the electric water pump 25 is not driven during operation of the internal combustion engine, the coolant does not flow in the electrical component cooling system.

The coolant at a relatively high temperature received from the engine water pump 22 is fed into the upper space of the radiator tank 12*a* through the coolant inlet 14 for the internal combustion engine. Then, the coolant is cooled by passing through the radiator 10 for the internal combustion engine, and the cooled coolant in an amount corresponding to the amount of coolant flow is supplied to the internal combustion engine through the outlet 16 for the internal combustion engine in the radiator tank 12*b*.

Even at this time, the bubbles collected in the upper space of the radiator tanks 12*a* and 12*b* can be removed through the reservoir tank 24*a*.

As such, with the use of the connection structure by the tube applied between the radiator for the internal combustion engine and the radiator for the electrical components, it is possible to easily remove the bubbles collected at the bottom of the radiator tanks, which improves the function of discharging bubbles in the cooling system, thus significantly improving the cooling efficiency of the electrical component cooling system as well as the internal combustion engine cooling system.

In other embodiments of the present invention, longitudinal axes of the first and second radiators are slanted with a predetermined angle to align the radiator tank 12*b* higher than the radiator tank 12*a*. In this structure, a flow rate of the bubbles between the radiator tank 12*a* and the radiator tank 12*b* can be controlled.

As described above, the integrated hybrid heat exchanger using a water head difference provided by the present invention has the following advantages.

1. Improvement in cooling efficiency: since it is easy to remove the bubbles collected at the top of the radiator tank of the radiator for the electrical components, the function of discharging bubbles generated in the cooling system is improved, and therefore it is possible to improve the flow resistance of coolant and the heat transfer efficiency, which results in an improvement in the cooling efficiency.

2. Different pressure caps used in the internal combustion engine cooling system and the electrical component cooling system: with the use of a water head difference of the tube, it is possible to easily discharge bubbles; however, the coolant flow occurs temporarily under given conditions.

3. Improvement in durability: with the tube connection structure, it is possible to facilitate the removal of bubbles generated during operation of the cooling system, minimize the flow of liquid fluid while discharging the bubbles, and, if an excess pressure is generated in one of the two radiators, relieve the excess pressure to balance the pressures of both radiators, thus preventing core deformation and fatigue failure due to the pressure difference between the two radiators.

4. Reduction in manufacturing cost: since the core portion of the electrical component cooling system and the core portion of the internal combustion engine cooling system are applied to one header and one tank, respectively, it is possible to reduce the manufacturing cost, compared to the conventional structure in which two heat exchangers are used.

5. Reduction in process: it is possible to eliminate one clinching process and weld at least two core portions at one time.

6. Reduction in weight and simplification in structure: since each of the tank and the header is eliminated, it is possible to reduce the weight and simplify the structure, compared to the conventional structure in which two heat exchangers are used.

For convenience in explanation and accurate definition in the appended claims, the terms "up" or "upper", "down", "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An integrated hybrid heat exchanger, comprising:

a first radiator and a second radiator disposed in parallel;

a first radiator tank connected to both first end portions of the first and second radiators in common;

a first baffle installed in the first radiator tank and separating an inner space of the first radiator tank into an upper space and a lower space, wherein the upper and lower spaces of the first radiator tank include a coolant inlet respectively so as to fluidly-connect the upper space of the first radiator tank to the first radiator and the coolant inlet installed at the upper space of the first radiator tank and to fluidly-connect the lower space of the first radiator tank to the second radiator and the coolant inlet installed at the lower space of the first radiator tank;

a first air bypass member having a passage therein, the first air bypass member installed on the first baffle and extending upwards with a predetermined length and configured to remove bubbles collected in the lower space of the first radiator tank through the passage of the first air bypass member by pressure difference between the upper and lower spaces of the first radiator tank;

a second radiator tank connected to both second end portions of the first and second radiators in common;

a second baffle installed in the second radiator tank and separating an inner space of the second radiator tank into an upper space and a lower space, wherein the upper and lower spaces of the second radiator tank include a coolant outlet respectively so as to fluidly-connect the upper space of the second radiator tank to the first radiator and the coolant outlet installed at the upper space of the second radiator tank and to fluidly-connect the lower space of the second radiator tank to the second radiator and the coolant outlet installed at the lower space of the second radiator tank; and a second air bypass member having a passage therein, the second air bypass member installed on the second baffle and extending upwards with a predetermined length and configured to remove bubbles collected in the lower space of the second radiator tank through the passage of the second air bypass member by pressure difference between the upper and lower spaces of the second radiator tank.

2. The integrated hybrid heat exchanger of claim 1, wherein the first air bypass member is configured to minimize a flow of fluid therethrough while discharging the bubbles when an excess pressure is generated in one of the first and second radiators.

3. The integrated hybrid heat exchanger of claim 1, wherein the first air bypass member is formed integrally with the first baffle.

4. The integrated hybrid heat exchanger of claim 1, wherein the first air bypass member passes through the first baffle and an end of the first air bypass member is assembled on the first baffle.

5. The integrated hybrid heat exchanger of claim 1, wherein the first baffle is disposed at the same level as a bottom portion of the first radiator and the predetermined length of the first air bypass member is shorter than the height of the first radiator from the bottom portion thereof.

6. The integrated hybrid heat exchanger of claim 1, wherein the upper space of the first radiator tank is fluidly-connected to a reservoir tank.

7. The integrated hybrid heat exchanger of claim 1, wherein the second air bypass member is configured to minimize a flow of fluid therethrough while discharging the bubbles when an excess pressure is generated in one of the first and second radiators.

8. The integrated hybrid heat exchanger of claim 1, wherein the second air bypass member is formed integrally with the second baffle.

9. The integrated hybrid heat exchanger of claim 1, wherein the second air bypass member is assembled on the second baffle in an insertion manner.

10. The integrated hybrid heat exchanger of claim 1, wherein the second baffle is disposed at the same level as a bottom portion of the second radiator and the predetermined length of the second air bypass member is shorter than the height of the second radiator from the bottom portion thereof.

11. The integrated hybrid heat exchanger of claim 1, wherein the upper space of the second radiator tank is fluidly-connected to a reservoir tank.

12. The integrated hybrid heat exchanger of claim 11, wherein the upper space of the first radiator tank is fluidly-connected to the reservoir tank.

13. The integrated hybrid heat exchanger of claim 1, wherein the coolant outlet of the first radiator is disposed lower than the coolant inlet thereof.

14. The integrated hybrid heat exchanger of claim 1, wherein the coolant outlet of the second radiator is disposed lower than the coolant inlet thereof.

15. The integrated hybrid heat exchanger of claim 1, wherein the first radiator is configured to cool an internal combustion engine and the second radiator is configured to cool electrical components.

16. The integrated hybrid heat exchanger of claim 1, wherein longitudinal axes of the first and second radiators are slanted with a predetermined angle to align the second radiator tank to be higher than the first radiator tank so as to control a flow rate of the bubbles between the first radiator tank and the second radiator tank.

17. A vehicle comprising the integrated hybrid heat exchanger of claim 1.

* * * * *